US009162269B2

(12) United States Patent
Fiorucci et al.

(10) Patent No.: US 9,162,269 B2
(45) Date of Patent: Oct. 20, 2015

(54) COIL FORMING APPARATUS AND METHOD

(71) Applicants: Keith E. Fiorucci, Sturbridge, MA (US); Christopher D. Lashua, Gardner, MA (US); Hugh T. O'Neill, Delray Beach, FL (US)

(72) Inventors: Keith E. Fiorucci, Sturbridge, MA (US); Christopher D. Lashua, Gardner, MA (US); Hugh T. O'Neill, Delray Beach, FL (US)

(73) Assignee: Primetals Technologies USA LLC, Alpharetta, GA (US)

( * ) Notice: Subject to any disclaimer, the term of this patent is extended or adjusted under 35 U.S.C. 154(b) by 257 days.

(21) Appl. No.: 13/742,476

(22) Filed: Jan. 16, 2013

(65) Prior Publication Data

US 2014/0145019 A1 May 29, 2014

Related U.S. Application Data

(60) Provisional application No. 61/731,115, filed on Nov. 29, 2012.

(51) Int. Cl.

| | |
|---|---|
| ***B21C 47/04*** | (2006.01) |
| ***B21C 47/24*** | (2006.01) |
| ***B21C 47/14*** | (2006.01) |

(52) U.S. Cl.

CPC ..... *B21C 47/242* (2013.01); *B21C 47/04* (2013.01); *B21C 47/14* (2013.01); *B21C 47/245* (2013.01)

(58) Field of Classification Search

CPC ..... B21C 47/02; B21C 47/04; B21C 47/045; B21C 47/06; B21C 47/063; B21C 47/066; B21C 47/08; B21C 47/10; B21C 47/12; B21C 47/14; B21C 47/143; B21C 47/146; B21C 47/242; B21C 47/245

USPC ..... 242/360–363

See application file for complete search history.

(56) References Cited

U.S. PATENT DOCUMENTS

| | | | | | |
|---|---|---|---|---|---|
| 4,357,965 | A | * | 11/1982 | Kosuge et al. | 140/2 |
| 4,437,620 | A | * | 3/1984 | Ozawa | 242/363 |
| 5,480,279 | A | | 1/1996 | Stauber | |
| 5,501,410 | A | * | 3/1996 | Starvaski | 242/363 |
| RE35,440 | E | | 2/1997 | Starvaski | |
| 5,735,477 | A | * | 4/1998 | Shore et al. | 242/363 |
| 5,779,174 | A | | 7/1998 | Ferrazza | |
| 5,967,439 | A | * | 10/1999 | Klein | 242/363 |
| 6,073,873 | A | * | 6/2000 | Shore et al. | 242/363 |
| 6,158,683 | A | * | 12/2000 | David et al. | 242/363 |
| 6,726,138 | B2 | | 4/2004 | Grimmel | |
| 7,424,987 | B2 | | 9/2008 | Bordignon | |

OTHER PUBLICATIONS

PCT International Search Report mailed Apr. 7, 2014 corresponding to PCT International Application No. PCT/US2013/069774 filed Nov. 13, 2013 (11 pages).

* cited by examiner

*Primary Examiner* — William E Dondero

(74) *Attorney, Agent, or Firm* — Gesmer Updegrove LLP

(57) ABSTRACT

An apparatus is disclosed for receiving a helical formation of rings free falling from the delivery end of a conveyor, and for gathering the rings into a coil. The apparatus comprises a vertically disposed mandrel having an upper end positioned for encirclement by the free falling rings. A vertically disposed support column is positioned adjacent to the mandrel. Upper and lower coil plate assemblies are carried by and vertically adjustable on the support column. A drive system vertically adjusts the coil plate assemblies in a descending manner in which the free falling rings encircling the mandrel are initially accumulated on the upper coil plate assembly before being transferred onto the lower coil plate assembly.

10 Claims, 11 Drawing Sheets

COIL FORMING APPARATUS AND METHOD

CROSS REFERENCE TO RELATED APPLICATION

This application claims benefit, under 35 U.S.C. §119(e), of U.S. Provisional Application Ser. No. 61/731,115, filed Nov. 29, 2012, the entire content and substance of which is hereby incorporated by reference.

BACKGROUND

1. Field

Embodiments of the present invention relate generally to rod rolling mills where the hot rolled product is formed into a helical series of rings that are subjected to controlled cooling while being transported in an overlapping pattern on a conveyor. The present invention is concerned in particular with an improved apparatus and method for receiving the rings as they free fall from the delivery end of the conveyor and for gathering the rings into cylindrical coils.

2. Description of Related Art

In the coil forming apparatus disclosed in U.S. Pat. No. 6,073,873 (Shore et al), support for the coil being formed from the free falling rings is initially provided by an upper coil plate assembly, and then by a lower coil plate assembly onto which the growing coil is transferred as the coil forming process continues to its conclusion. The two coil plate assemblies are operable in concert to allow formation of the coil in a so called "stepless" manner, i.e., without abruptly dropping packets of the rings. However, the advantage of doing so is largely offset by significant drawbacks, not the least of which is the unduly complicated and expensive system for supporting, vertically adjusting and coordinating the movement of the two coil plate assemblies.

SUMMARY

Broadly stated, embodiments of the present invention avoid the above described drawbacks by providing an improved apparatus and method for supporting and vertically adjusting the coil plate assemblies. Compared to the apparatus disclosed in the above-referenced Shore et al. patent, embodiments of the present invention are less expensive, more compact and easier to operate and control.

In exemplary embodiments of the present invention, the apparatus comprises a vertically disposed mandrel having an upper end positioned for encirclement by the free falling rings. A vertically disposed support column is positioned adjacent to the mandrel, and upper and lower coil plate assemblies are carried by and vertically adjustable on the support column. A drive system vertically adjusts the coil plate assemblies in a descending manner in which the free falling rings encircling the mandrel are initially accumulated on the upper coil plate assembly before being transferred onto the lower coil plate assembly.

The drive system preferably comprises a rack extending vertically along the length of the support column. Pinions carried by the coil plate assemblies are in meshed relationship with the rack, and motors carried by the coil plate assemblies drive the pinions.

The support surface of the lower coil plate assembly is preferably interrupted by gaps through which the upper coil plate assembly may be lowered to effect the transfer of initially accumulated rings from the upper coil plate assembly onto the lower coil plate assembly.

Advantageously, during transfer of the initially accumulating rings from the upper coil plate assembly onto the lower coil plate assembly, the drive system may be operated to simultaneously lower both coil plate assemblies at different speeds selected to ensure that the transfer occurs smoothly.

Preferably, each coil plate assembly includes multiple segments in the form of arms that may be adjusted between closed positions enclosing the mandrel and in the path of the free falling rings, and open positions remote from the mandrel and out of said path.

These and other features and advantages of the present invention will become more apparent upon reading the following detailed description in conjunction with the accompanying drawings.

DETAILED DESCRIPTION

Figure 1:
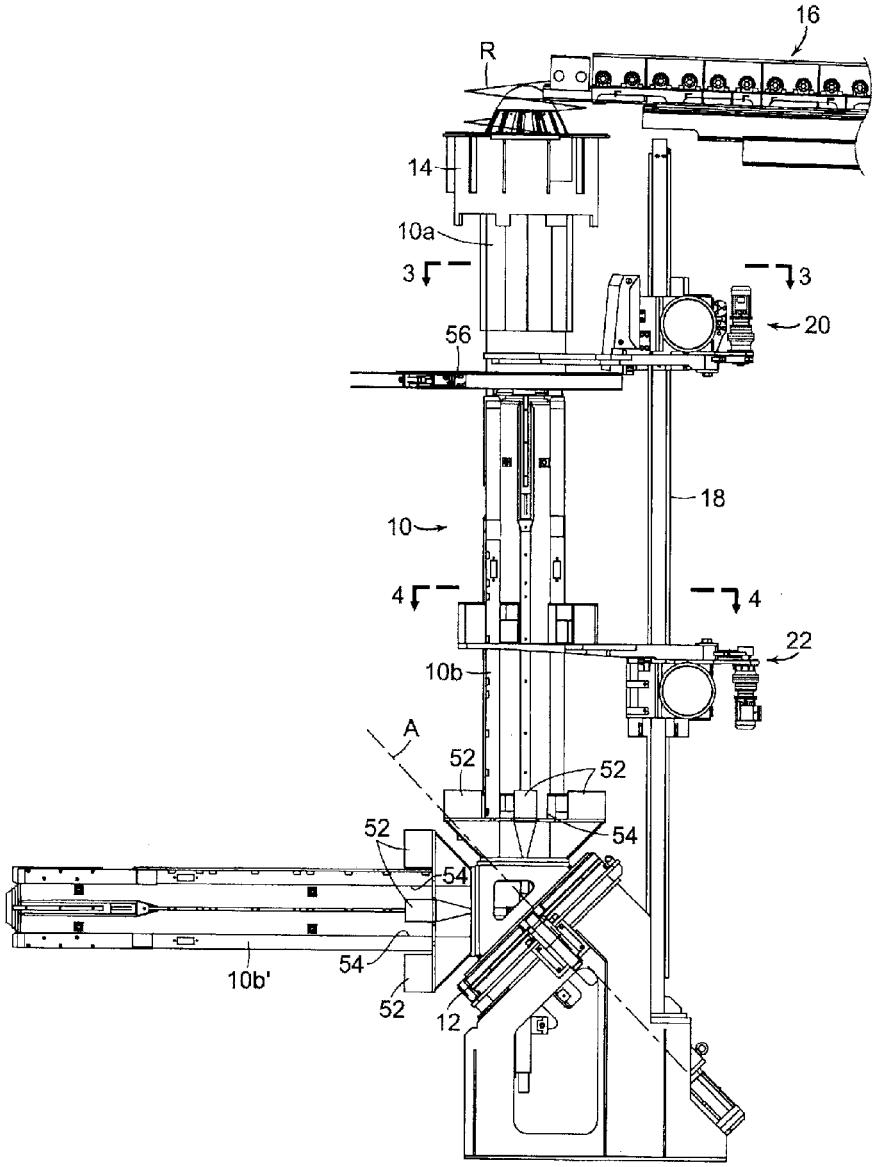
FIG. 1 is a side view of an apparatus in accordance with an exemplary embodiment of the present invention.

The components described hereinafter as making up the various embodiments are intended to be illustrative and not restrictive. Many suitable components that would perform the same or a similar function as well as the materials described herein are intended to be embraced within the scope of embodiments of the present invention.

Referring now to the figures, when like reference numerals represent like parts throughout the view, embodiments of the present invention will now be described in detail.

Figure 2:
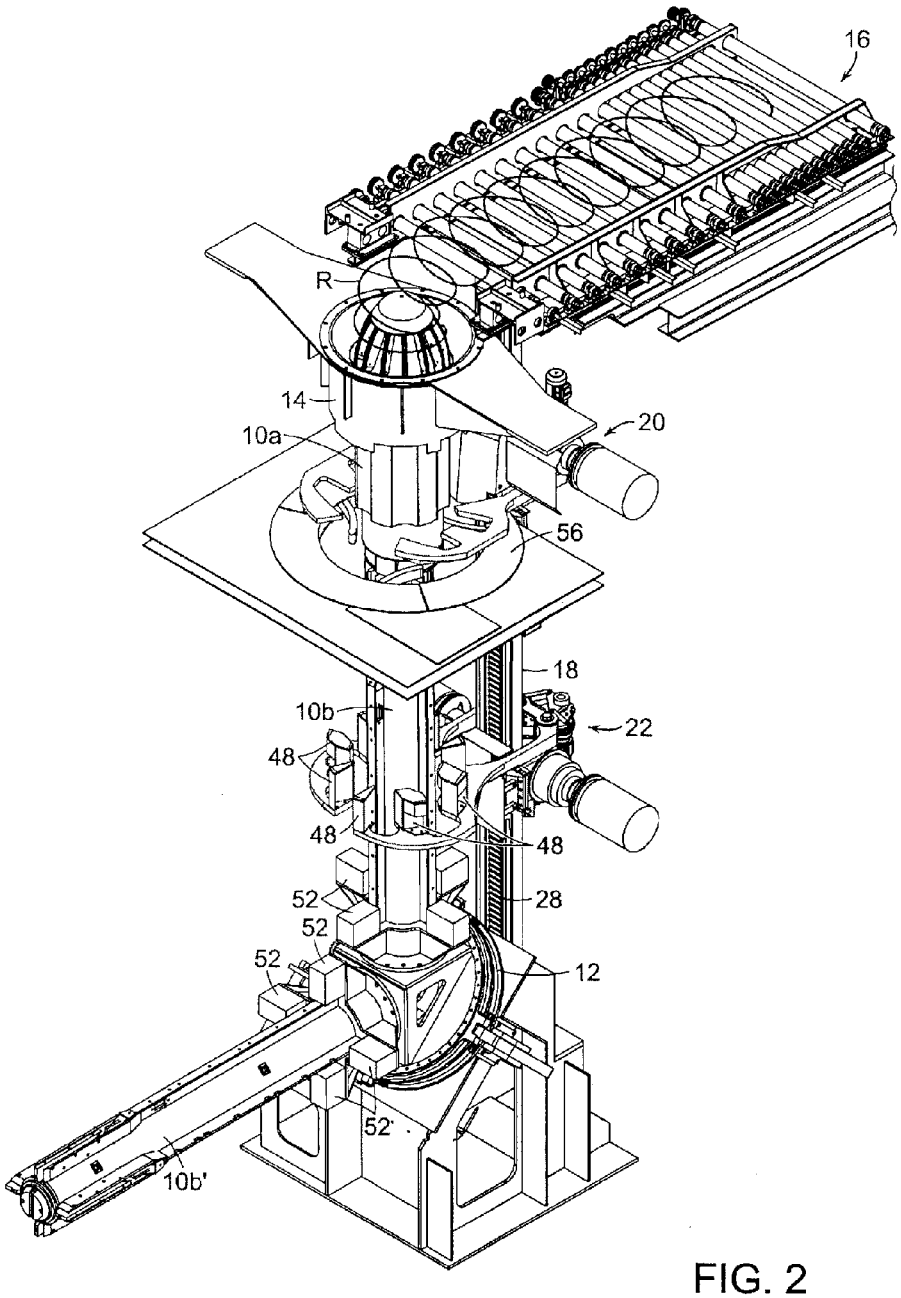
FIG. 2 is a front perspective view of an apparatus in accordance with an exemplary embodiment of the present invention.

With reference initially to FIGS. 1 and 2, an apparatus in accordance with an exemplary embodiment of the present invention is shown comprising a vertically disposed mandrel 10 having an upper end 10*a* (commonly referred to as a "nose cone") separable from an underlying stem 10*b*. The mandrel stem 10*b* and a companion mandrel stem 10*b*' are arranged orthogonally on a base 12. The base is rotatable about an axis The upper end 10*a* of the mandrel 10 projects upwardly into a reforming chamber 14, and is positioned for encirclement by rings "R" free falling from the delivery end of a conveyor 16.

A vertically disposed support column 18 is positioned adjacent to the mandrel 10. Upper and lower coil plate assemblies 20, 22 are carried by and vertically adjustable on the support column 18. As can best be seen by a reference to FIGS. 3 and 3A, the upper coil plate assembly 20 has an array of rollers 24 arranged to contact guide rails 26 on the support column 18.

The upper coil plate assembly 20 is vertically adjustable by means of a drive system comprising a gear rack 28 extending vertically along the support column 18. A pinion 30 is in meshed relationship with the rack 28. Pinion 30 is carried on a shaft 32 driven by a motor 34 or the like.

Figure 4:
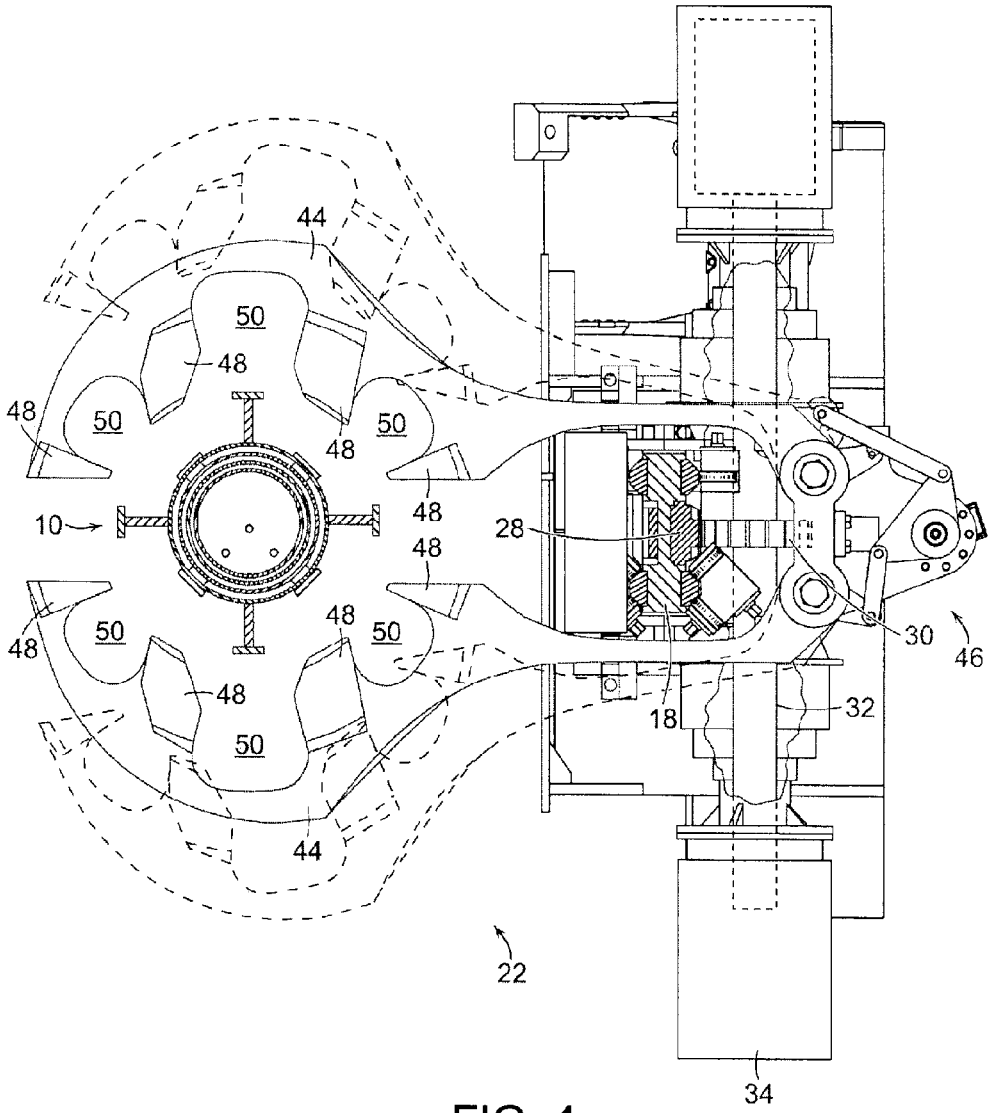
FIG. 4 is a horizontal sectional view taken on line 4-4 of FIG. 1.

As shown in FIG. 4, the lower coil plate assembly 22 is similarly equipped with an array of rollers contacting the guide rails on the support column, and with a pinion 30 in meshed relationship with the rack 28, and carried on a shaft 32 driven by a motor 34.

Figure 3:
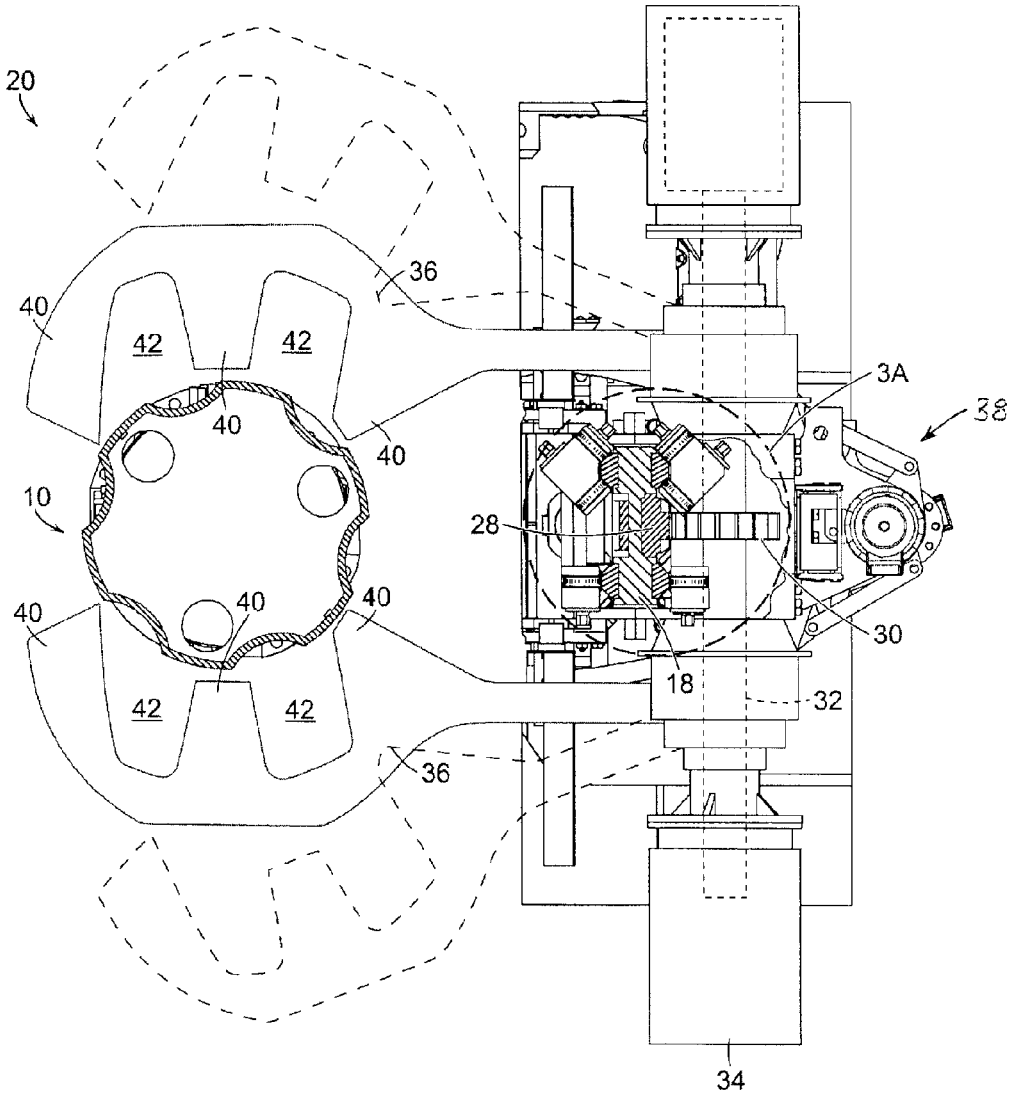
FIG. 3 is a horizontal sectional view taken on line 3-3 of FIG. 1.
Figure 3A:
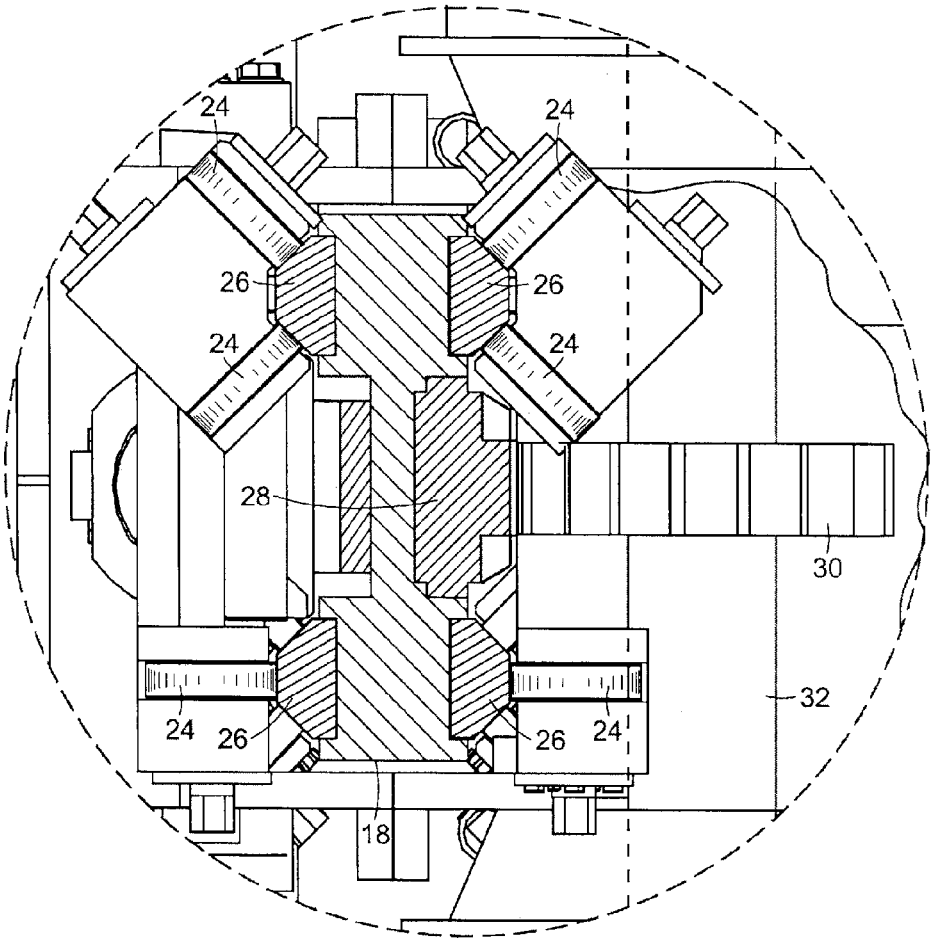
FIG. 3A is an enlarged diagramatic view of the circled area of FIG. 3.

Again, as shown in FIG. 3, the upper coil plate assembly includes a support surface subdivided into segments in the form of a pair of arms 36. A motor driven linkage system 38 serves to pivotally adjust the arms 36 between closed positions enclosing the mandrel 10 and in the path of rings encircling the mandrel, and open positions (shown by broken lines) remote from the mandrel and said path. The arms have scalloped interior edges defining fingers 40 separated by gaps 42.

As depicted in FIG. 4, the lower coil plate assembly 22 also includes a support surface subdivided into segments in the form of a pair of arms 44. A motor driven linkage system 46 serves to adjust the arms 44 between closed positions enclosing the mandrel 10 and open positions (shown by broken lines) remote from the mandrel 10 and the path of the rings encircling the mandrel.

As can be seen by additional reference to FIG. 2, the support surface of the lower coil plate assembly 22 is defined by pedestals 48 on the arms 44. The pedestals 48 are separated by gaps 50.

When the arms of both the upper and lower coil plate assemblies are closed, the fingers 40 of the upper coil plate assembly 20 are aligned with the gaps 50 of the lower coil assembly 22, and the pedestals 48 of the lower coil plate assembly are aligned with the gaps 42 of the upper coil plate assembly 20.

At the lower end of each mandrel stem 10*b*, 10*b*', the base 12 is provided with pedestals 52 separated by gaps (identified by the reference numeral 54 in FIG. 1). When the arms 44 of the lower coil plate assembly 22 are closed, the pedestals 48 are aligned with the gaps 54 between the pedestals 52 of the base 12, and the pedestals 52 are aligned with the gaps 50 between the pedestals 48 of the arms 44.

The operation of the apparatus in the course of a typical coil forming operation will now be described with reference to FIGS. 5A-5F.

Figure 5A:
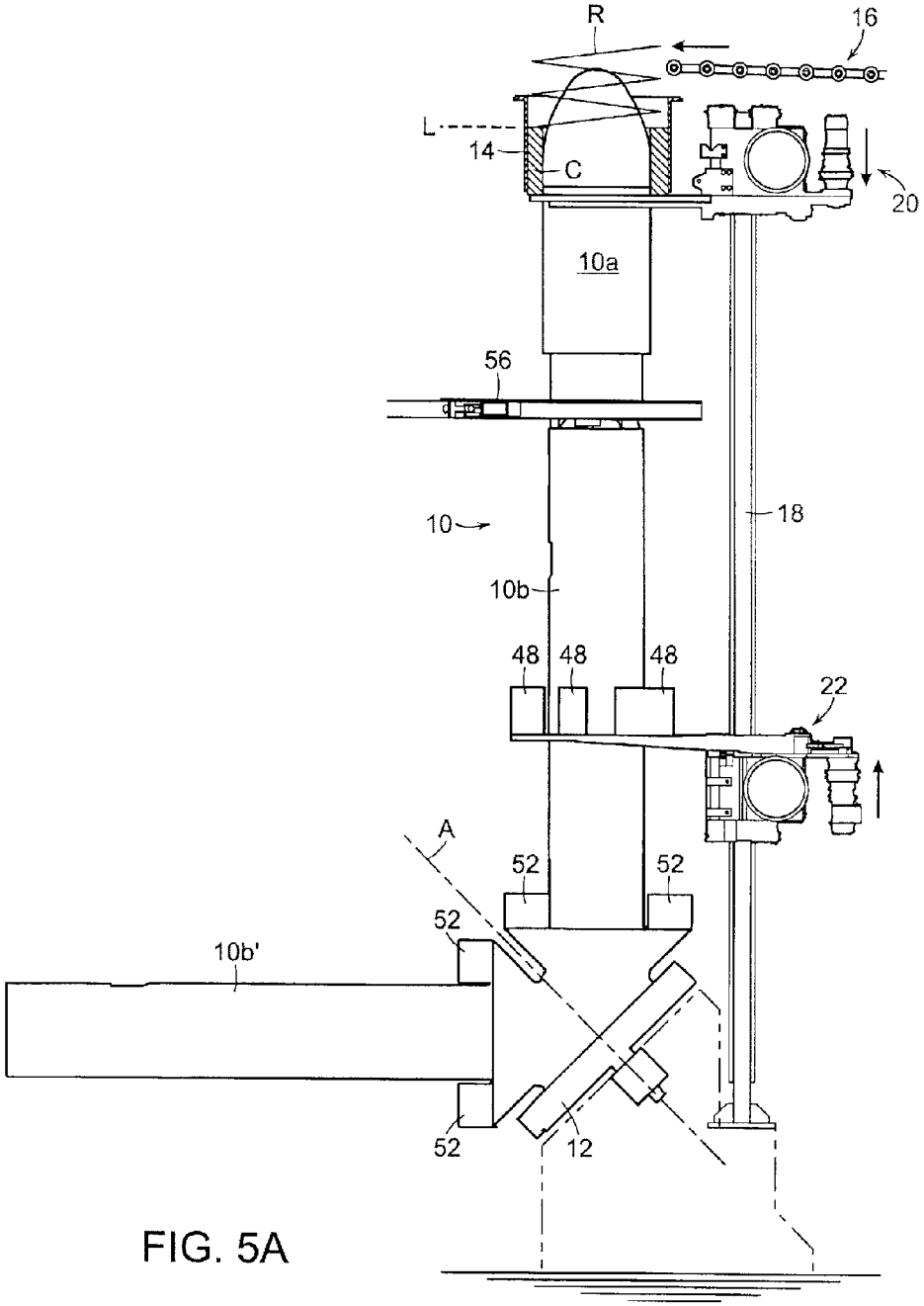
FIGS. 5A-5F are diagramatic side views of an exemplary embodiment of the present invention showing successive stages in the coil forming process.

At the stage depicted in FIG. 5A, rings R are free falling from the delivery end of conveyor 16 where they are accumulating around the upper end 10*a* of the mandrel. The rings are accumulating in a growing coil C on the support surfaces (closed arms 36) of the upper coil plate assembly 20. The upper coil plate assembly 20 is being lowered gradually at a rate selected to maintain the top of the accumulating coil C at level "L", and the lower coil plate assembly 22 is being elevated, with its arms 44 in their open position.

Figure 5B:
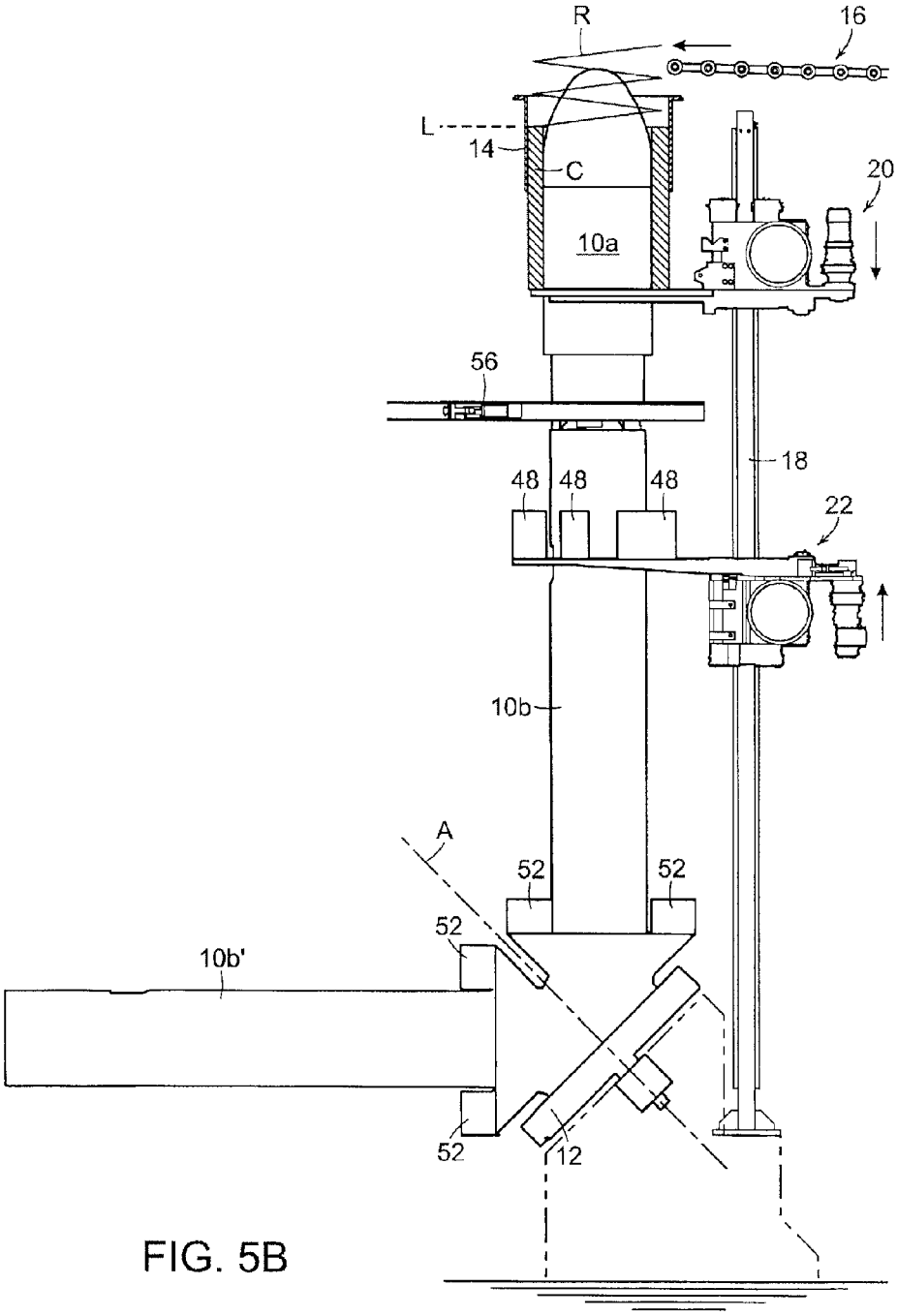

FIG. 5B shows the two coil plate assemblies in motion, with the upper coil plate assembly continuing to drop at a rate maintaining the top of the coil C at level L.

Figure 5C:
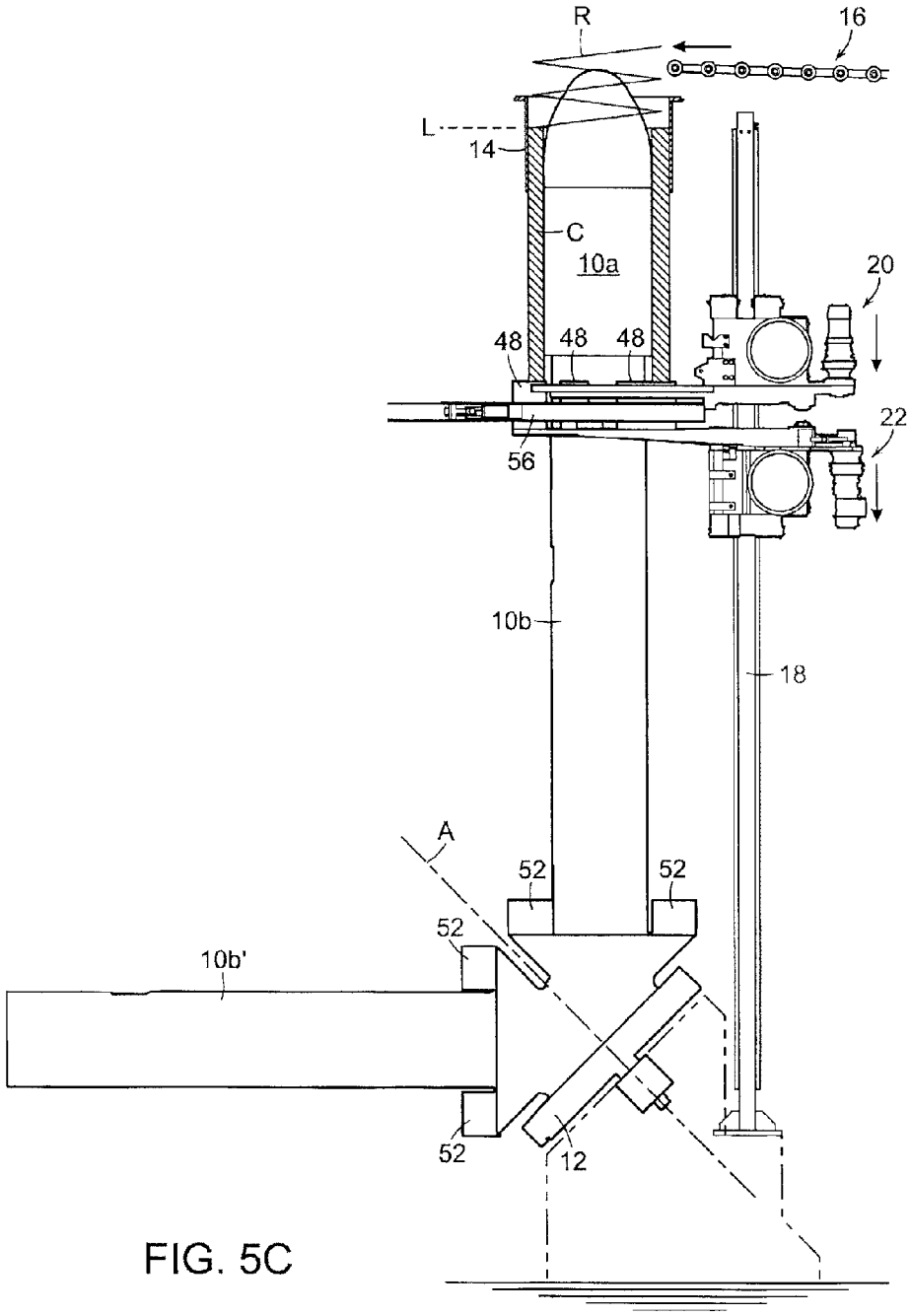

At the stage shown in FIG. 5C, the fingers 40 of the upper coil plate assembly 20 have descended through the gaps 50 between the pedestals 48 of the lower coil plate assembly 22 to thereby transfer the support of the accumulating coil C onto the lower coil plate assembly 22. Preferably, at the time of transfer, both coil plate assemblies are dropping simultaneously, with a speed differential selected to maximize the smoothness of transfer.

Figure 5D:
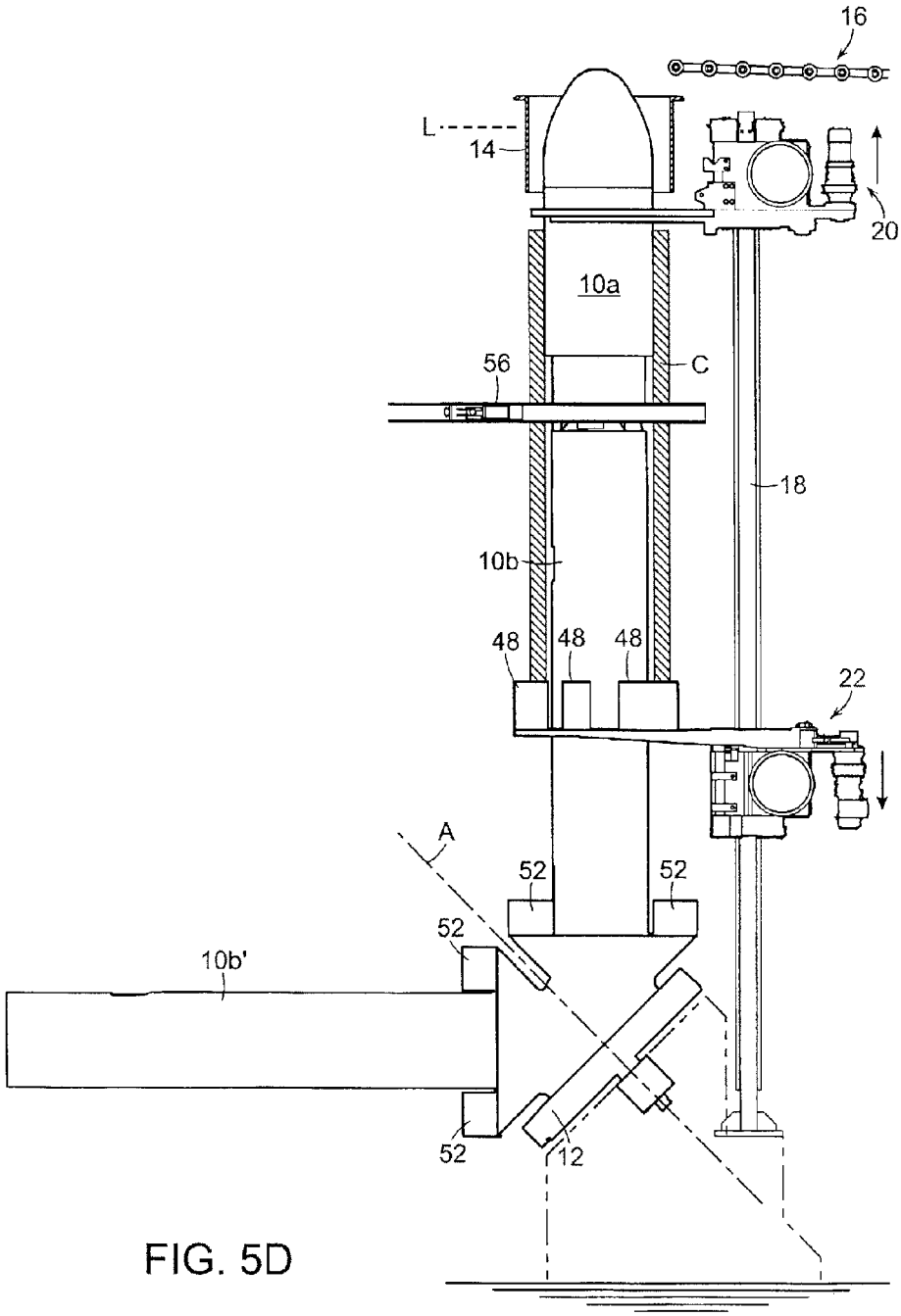

FIG. 5D shows the lower coil plate assembly 22 continuing to drop after one complete coil has been formed. The upper coil plate assembly is continuing to elevate towards its uppermost position.

Figure 5E:
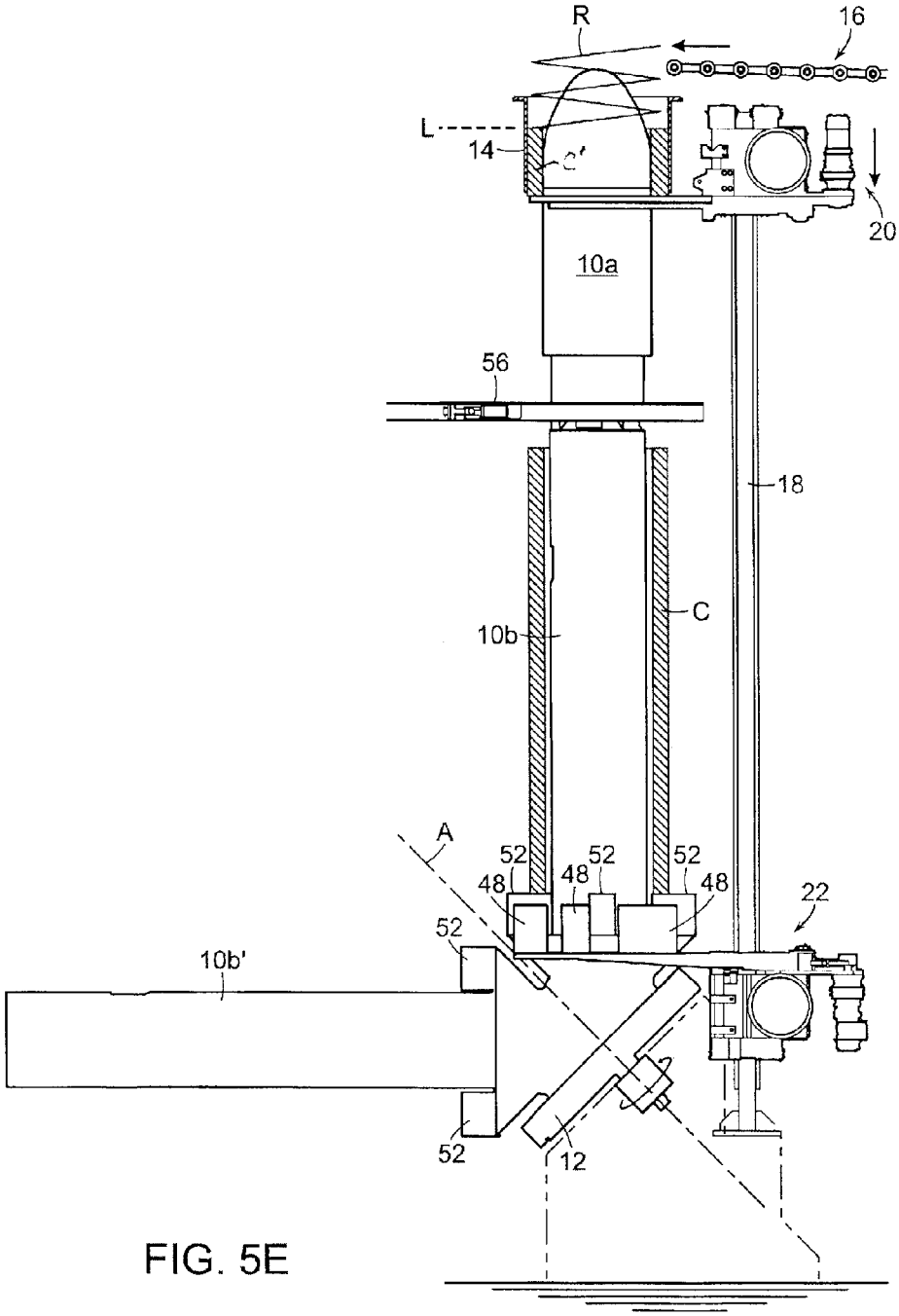

In FIG. 5E, the pedestals 48 of the lower coil plate assembly 22 have been lowered through the gaps 54 between the pedestals 52 of the base 12, thereby transferring support of the coil C onto the base 12. The upper coil plate assembly 20 is again dropping gradually during formation of the next successive coil C'.

At this junction, a mechanism 56 of known design is activated to support the upper end 10*a* of the mandrel, allowing the mandrel stem 10*b* to be retracted to an extent sufficient to accommodate rotation of the base 12 about axis A.

Figure 5F:
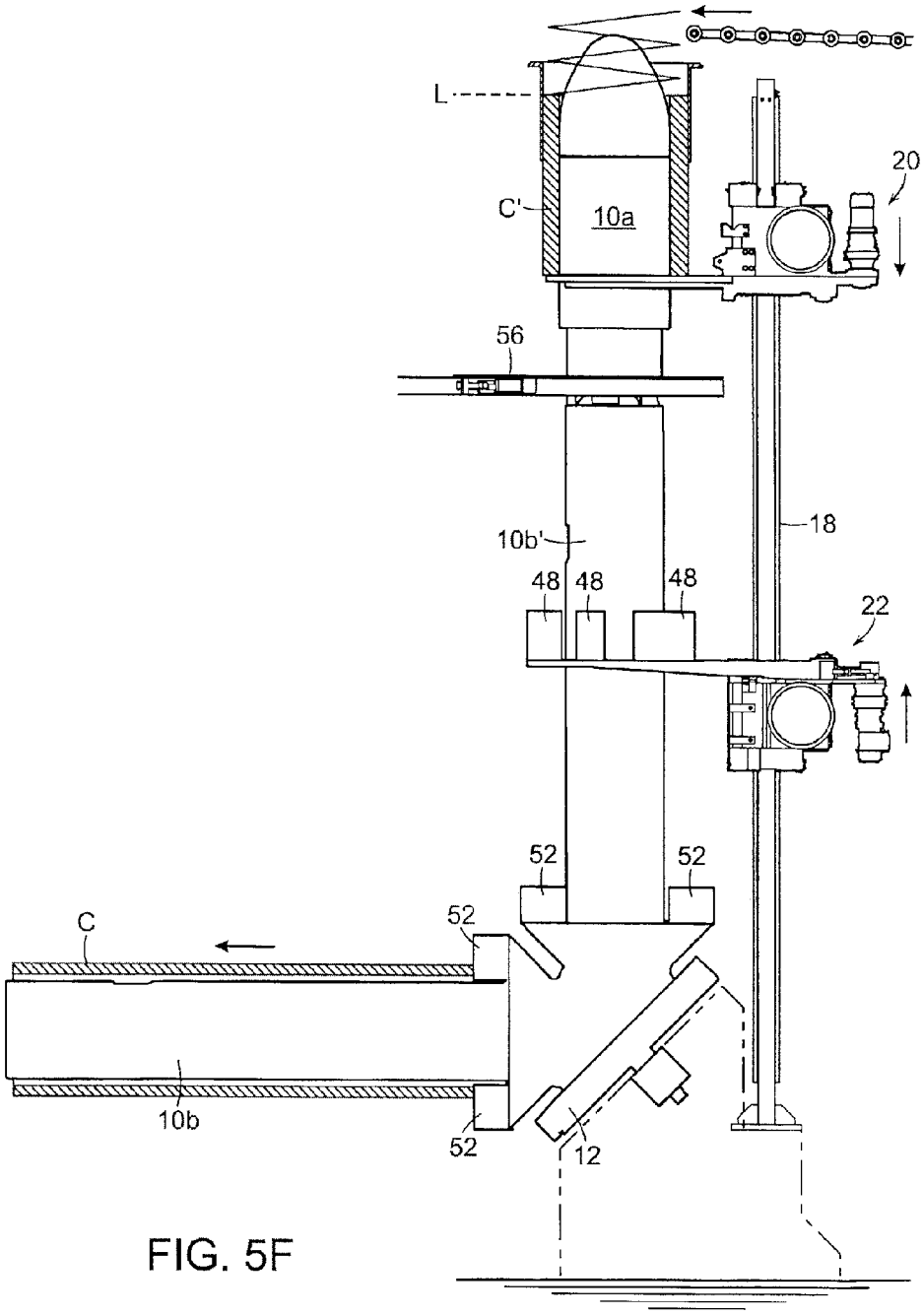

At the stage shown in FIG. 5F, the base 12 has been rotated to reorient the loaded stem 10*b* horizontally, and to position the companion stem 10*b*' vertically. Stem 10*b*' has been extended to again support the upper mandrel end 10*a*, the mechanism 56 has been deactivated, the upper coil plate assembly 20 continues to drop as the next coil C' is being accumulated, and the lower coil plate assembly 22 is again being elevated to a level at which it will be positioned to participate in the next transfer.

While exemplary embodiments of the invention have been disclosed, modifications, additions and deletions may be made without departing from the spirit and scope of the invention and its equivalents, as set forth in the following claims.

We claim:

1. Apparatus for receiving a helical formation of rings free falling from the delivery end of a conveyor, and for gathering the rings into a coil, said apparatus comprising:

a vertically disposed mandrel having an upper end positioned for encirclement by the free falling rings;

a vertically disposed support column positioned adjacent to said mandrel;

upper and lower coil plate assemblies carried by and vertically adjustable on said support column; and a drive system for vertically adjusting said coil plate assemblies in a descending manner in which the free falling rings encircling said mandrel are initially accumulated on said upper coil plate assembly before being transferred onto said lower coil plate assembly.

2. The apparatus of claim 1 wherein said drive system comprises a rack extending vertically along the length of said support column, pinions carried by said upper and lower coil plate assemblies, said pinions being in meshed relationship with said rack, and first drive motors for driving said pinions to effect the vertical adjustment of said coil plate assemblies.

3. The apparatus of claim 1 wherein said lower coil plate assembly has a support surface interrupted by gaps, and wherein the transfer of the initially accumulating rings from said upper coil plate assembly onto said lower coil plate assembly is achieved by lowering said upper coil plate assembly through said gaps to a level beneath said support surface.

4. The apparatus of claim 3 wherein said drive system is operable to simultaneously lower both of said coil plate assemblies during the transfer of the initially accumulating rings from said upper coil plate assembly onto said lower coil plate assembly.

5. The apparatus of claim 1 wherein said coil plate assemblies include multiple segments, with a second drive system for manipulating said segments between closed positions enclosing said mandrel and in the path of said free falling rings, and open positions remote from said mandrel and said path.

6. Apparatus for receiving a helical formation of rings free falling from the delivery end of a conveyor, and for gathering the rings into a cylindrical coil, said apparatus comprising:

a vertically disposed mandrel having an upper end positioned for encirclement by the free falling rings;

a vertically disposed support column;

upper and lower vertically adjustable coil plate assemblies carried on said support column; said lower coil plate assembly having a support surface interrupted by gaps;

a first drive system for positioning said upper coil plate assembly on said support column at a first level above said lower coil plate assembly and at which level the free falling rings are temporarily accumulated on said upper coil plate assembly, said first drive system being operative to lower said upper coil plate assembly through the gaps in the support surface of said lower coil plate assembly to a second level beneath said support surface, thereby transferring the rings temporarily accumulating on said upper coil plate assembly onto said support surface;

a second drive system for removing said upper coil plate assembly from beneath said support surface;

said first drive system being operable to lower said lower coil plate assembly during continued accumulation of rings thereon.

7. A method of receiving a helical formation of rings free falling from the delivery end of a conveyor, and for gathering the rings into a coil, said method comprising:

providing a vertically disposed mandrel with an upper end positioned for encirclement by the free falling rings;

positioning a vertically disposed support column adjacent to said mandrel;

mounting vertically adjustable upper and lower coil plate assemblies on said support column; and vertically adjusting said coil plate assemblies in a descending manner in which the free falling rings encircling said mandrel are initially accumulated on said upper coil plate assembly before being transferred onto said lower coil plate assembly.

8. The method of claim 7 wherein both of said coil plate assemblies are lowered simultaneously at different speeds during the transfer of the temporarily accumulating rings from said upper coil plate assembly onto said lower coil plate assembly.

9. The method of claim 7 wherein said lower coil plate assembly has a support surface interrupted by gaps, wherein said upper coil plate assembly is initially positioned to temporarily accumulate the free falling rings at an upper level above said lower coil plate assembly, and wherein the transfer of said temporarily accumulating rings is effected by gradually lowering said upper coil plate assembly through said gaps to a lower level beneath said support surface.

10. The method of claim 9 wherein the support surface of said lower coil plate assembly is subdivided into multiple segments enclosing said mandrel and in the path of the free falling rings, and wherein following the lowering of said upper coil plate assembly to said lower level, said segments are adjusted to open positions remote from said mandrel and said path, and said upper coil plate assembly is elevated to its initial position and said segments are readjusted to again enclose said mandrel and in said path.

* * * * *